US008651688B1

(12) United States Patent
Golden

(10) Patent No.: US 8,651,688 B1
(45) Date of Patent: Feb. 18, 2014

(54) FLASHLIGHT ACCESSORY

(76) Inventor: Jeremy D. Golden, Asheville, NC (US)

( * ) Notice: Subject to any disclaimer, the term of this patent is extended or adjusted under 35 U.S.C. 154(b) by 192 days.

(21) Appl. No.: 13/401,133

(22) Filed: Feb. 21, 2012

(51) Int. Cl.
*F21V 21/00* (2006.01)

(52) U.S. Cl.
USPC ..... 362/191; 362/190; 362/208; 362/347

(58) Field of Classification Search
USPC ..... 362/190, 191, 208, 347
See application file for complete search history.

(56) References Cited

U.S. PATENT DOCUMENTS 5,577,697 A * 11/1996 Accordino ..... 248/206.5
5,893,630 A * 4/1999 Mosquera ..... 362/191
6,206,542 B1 * 3/2001 Case et al. ..... 362/190
6,267,487 B1 * 7/2001 Tucker et al. ..... 362/382
7,434,954 B1 * 10/2008 Edgar ..... 362/197
2012/0140455 A1 * 6/2012 Chang ..... 362/183

* cited by examiner

*Primary Examiner* — Stephen F Husar
*Assistant Examiner* — James Cranson, Jr.
(74) *Attorney, Agent, or Firm* — Kyle Fletcher

(57) ABSTRACT

The flashlight accessory is a device that attaches onto a lighted end of an existing flashlight, and which reflects light radially from said flashlight in order to produce lighting consistent with a lantern. The flashlight accessory includes a hollowed cylinder within which a reflective cone shaped surface reflects light radially with respect to the hollowed cylinder. The hollowed cylinder includes an opening upon which the lighted end of the flashlight is placed against. A strap is provided at a distance above said opening in order to secure the flashlight accessory onto the lighted end of the flashlight. At least one hook is included on a distal end of said cylinder, and which enables the accessory to hang from an object in a manner consistent with a traditional lantern.

20 Claims, 5 Drawing Sheets

FLASHLIGHT ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of flashlights, more specifically, an accessory that attaches onto a flashlight, and which reflects light in a manner consistent with a lantern.

Flashlights and lanterns have been around for a long time, and provide illumination in poorly lit conditions. However, there is no attachment or accessory for a flashlight, which transforms the output light of said flashlight into radially directed light such that the flashlight in effect becomes a lantern.

The device of the present application addresses the need to provide a lantern lighting effect to a handheld flashlight.

B. Discussion of the Prior Art

As will be discussed immediately below, no prior art discloses a flashlight accessory that attaches onto the lighted end of a flashlight, and which reflects light in a manner consistent with a lantern; wherein the flashlight accessory includes a hollowed cylinder in which a reflective cone shaped surface is positioned adjacent the lighted end of the flashlight, and which reflects said light radially with respect to the flashlight; wherein the hollowed cylinder includes an opening in order to abut said lighted end of the flashlight; wherein a strap is provided at a distance above said opening in order to tighten the flashlight accessory onto said flashlight; wherein at least one hook extends from a distal end of said cylinder in order to enable the entire accessory to hang from an object in a manner analogous with use of a lantern.

The Chien Patent Application Publication (U.S. Pub. No. 2001/0033481) discloses a multiple function electro-luminescent night light device that may act as a flashlight or a lantern. However, the device is not an accessory that attaches onto the lighted end of a flashlight in order to reflect light radially in a manner consistent with a lantern.

The Lin Patent Application Publication (U.S. Pub. No. 2009/0135611) discloses a multi-functional lantern that includes a body, at least one light bar, and a flashlight assembly. Again, the lantern is not an accessory that attaches onto a lighted end of a flashlight, and which reflects light radially.

The Coultas et al. patent (U.S. Pat. No. 5,681,106) discloses a flexible adjustable lantern adaptor for hand held flashlights. However, the lantern adaptor does not include a hollowed cylinder within which a reflective cone shaped surface reflects light radially.

The Klees patent (U.S. Pat. No. 6,685,337) discloses a combination flashlight/candle lantern with a modified lower base designed to be used with the standard, metallic cover on a candle lantern. However, the flashlight/candle lantern is not an accessory that attaches onto a lighted end of an existing flashlight.

The Bertken patent (U.S. Pat. No. 7,845,820) discloses a multipurpose lighting device comprising a module including a first light source for a flashlight function and a second light source for a lantern. Again, the device is not an accessory that attaches onto a lighted end of an existing flashlight, and which reflects light radially in a manner consistent with a lantern.

The Ohashi patent (U.S. Pat. No. Des. 308,254) illustrates an ornamental design for a combined flashlight and fluorescent lantern, which is not a flashlight accessory.

The Yuen patent (U.S. Pat. No. Des. 373,209) illustrates an ornamental design for a combined fluorescent lantern and flashlight, and which is not an accessory for use with an existing flashlight.

While the above-described devices fulfill their respective and particular objects and requirements, they do not describe a flashlight accessory that attaches onto the lighted end of a flashlight, and which reflects light in a manner consistent with a lantern; wherein the flashlight accessory includes a hollowed cylinder in which a reflective cone shaped surface is positioned adjacent the lighted end of the flashlight, and which reflects said light radially with respect to the flashlight; wherein the hollowed cylinder includes an opening in order to abut said lighted end of the flashlight; wherein a strap is provided at a distance above said opening in order to tighten the flashlight accessory onto said flashlight; wherein at least one hook extends from a distal end of said cylinder in order to enable the entire accessory to hang from an object in a manner analogous with use of a lantern. In this regard, the flashlight accessory departs from the conventional concepts and designs of the prior art.

SUMMARY OF THE INVENTION

The flashlight accessory is a device that attaches onto a lighted end of an existing flashlight, and which reflects light radially from said flashlight in order to produce lighting consistent with a lantern. The flashlight accessory includes a hollowed cylinder within which a reflective cone shaped surface reflects light radially with respect to the hollowed cylinder. The hollowed cylinder includes an opening upon which the lighted end of the flashlight is placed against. A strap is provided at a distance above said opening in order to secure the flashlight accessory onto the lighted end of the flashlight. At least one hook is included on a distal end of said cylinder, and which enables the accessory to hang from an object in a manner consistent with a traditional lantern.

It is an object of the invention to provide an accessory that attaches onto a lighted end of an existing flashlight, and which reflects light produced from said existing flashlight radially, and in a manner consistent with a lantern.

A further object of the invention is to provide a flashlight accessory that includes a hollowed cylinder within which a reflective cone shaped surface is aligned in front of the lighted end of the existing flashlight.

An even further object of the invention is to provide a hollowed cylinder within which an opening is provided to enable a portion of the lighted end of the flashlight to be seated there against in order to direct light produced from said flashlight directly at the reflective cone shaped surface.

A further object of the invention is to provide a strap that is located at a distance above said opening, and which tightens to secure the flashlight accessory onto the lighted end of said flashlight.

Another object of the invention is to provide at least one hook at an external distal end of the hollowed cylinder, which enables the accessory and attached flashlight to hang from an object in a manner consistent with a traditional lantern.

These together with additional objects, features and advantages of the flashlight accessory will be readily apparent to those of ordinary skill in the art upon reading the following detailed description of presently preferred, but nonetheless illustrative, embodiments of the flashlight accessory when taken in conjunction with the accompanying drawings.

In this respect, before explaining the current embodiments of the flashlight accessory in detail, it is to be understood that the flashlight accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flashlight accessory.

It is therefore important that the claims be regarded as including such equivalent construction insofar as they do not depart from the spirit and scope of the flashlight accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
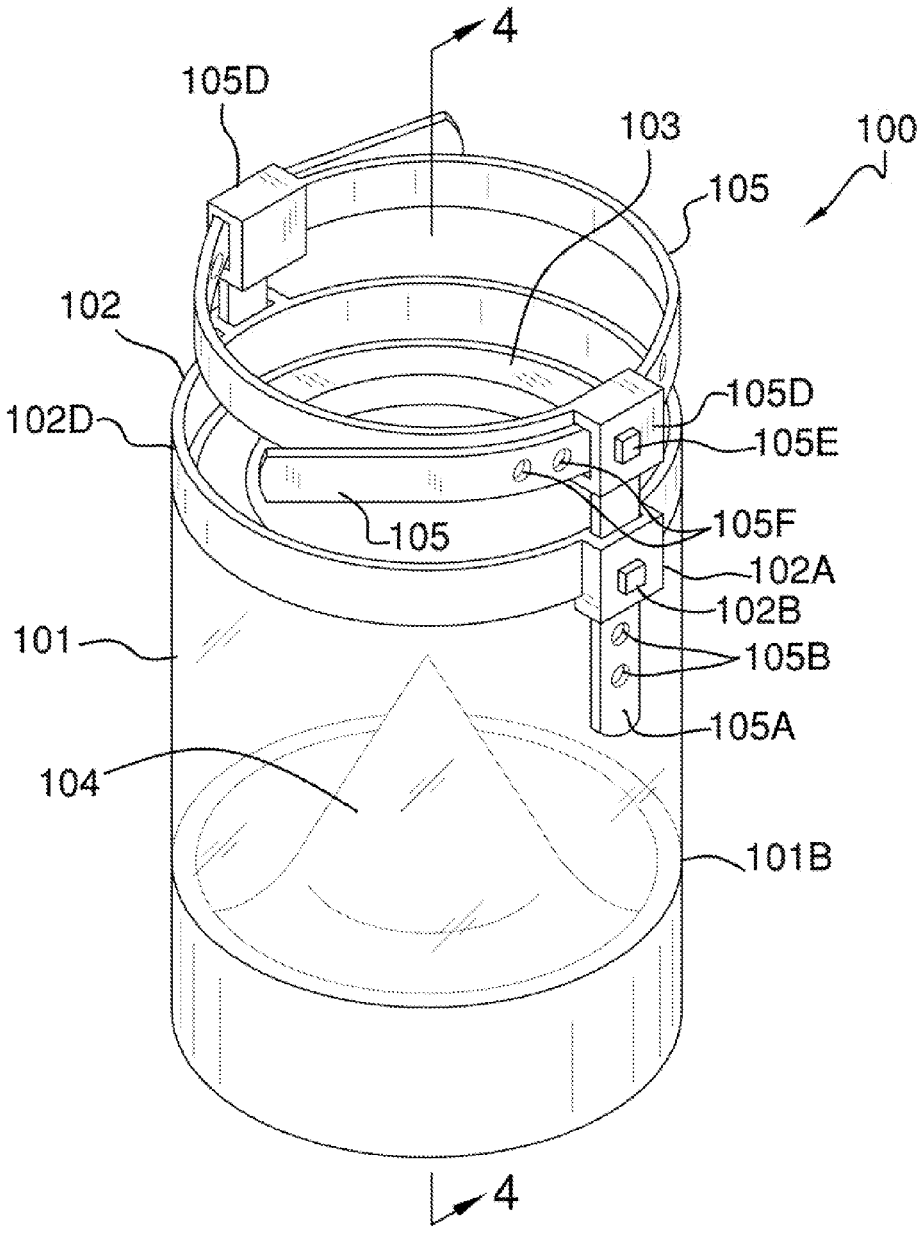
FIG. 1 illustrates a perspective view of the flashlight accessory by itself, and depicting a hollowed cylinder with reflective cone shaped surface located therein and the strap positioned above the opening of the hollowed cylinder.
Figure 2:
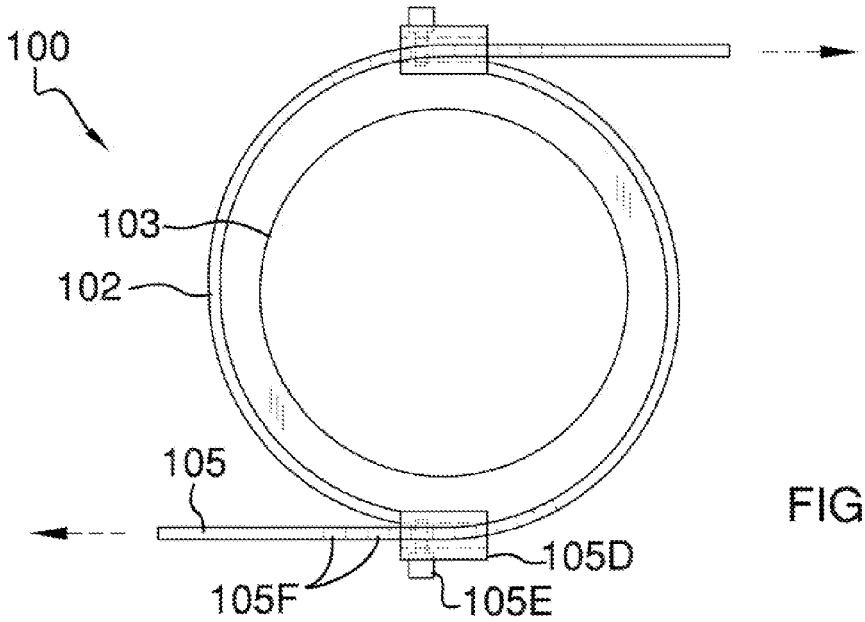
FIG. 2 illustrates a top view of the flashlight accessory in which an arrow indicates movement of the strap in order to tighten the area encircled by the strap, which is above the opening to the hollowed cylinder.
Figure 3:
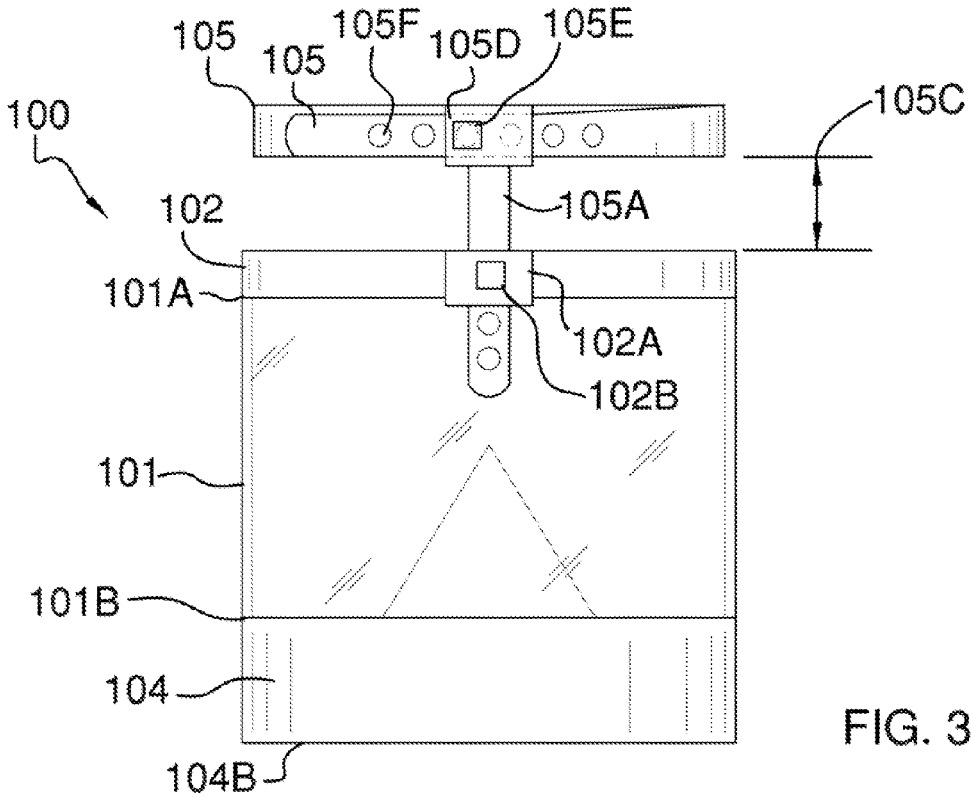
FIG. 3 illustrates a side view of the flashlight accessory further detailing the position of the strap above the opening of the hollowed cylinder.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A flashlight accessory 100 (hereinafter invention) includes a hollowed cylinder 101 that further defined by a top, opening 101A. The hollowed cylinder 101 is made of a translucent material, which enables light to easily pass there through.

A collar 102 is affixed to the top, opening 101A of the hollowed cylinder 101 and extends vertically therefrom. A support lip 103 is provided along the intersection of the collar 102 and the top, opening 101A of the hollowed cylinder 101. The support lip 103 acts as a stop, and prevents a flashlight 130 from protruding through the top, opening 101A of the hollowed cylinder 101. Moreover, a lighted end 131 of the flashlight 130 shall abut the support lip 103. The support lip 103 is a ring-shaped object, which forms a hole 103A through which light 140 from the flashlight 130 may pass through. The collar 102 is constructed of a flexible material, such as a rubber or plastic. The collar 102 is not translucent.

Both the collar 102 and the hollowed cylinder 101 are of an undefined length. The hollowed cylinder 101 includes a bottom, opening 101B. A reflective cone shaped surface 104 attaches onto the bottom, opening 101B of the hollowed cylinder 101. The reflective cone shaped surface 104 is coated in a highly reflective material such that upon shining light 140 from the flashlight 130, said light 140 shall be reflected radially as reflected light 141 with respect to the direction of light 140 exiting the flashlight 130.

The collar 102 includes at least one collar receiver 102A provided on an exterior surface 102D of the collar 102. The collar receiver 102A works in conjunction with at least one strap 105 to secure the flashlight 130 to the invention 100. Moreover, the strap 105 includes a first member 105A that includes a plurality of equally spaced first holes 105B thereon. The first member 105A is slideably engaged with respect to the collar receivers 102A such that the strap 105 can adjust an elevation 105C above the collar 102. The collar receivers 102A each include a first pin 102B that slides in and out to lock in a designated first hole 105B of the first member 105A, and thereby adjusting the elevation 105C of the strap 105 above the collar 102 (see FIG. 4).

It shall be noted that the figures depict two diametrically opposed collar receivers 102A and first members 105A. Moreover, the invention 100 may employ a plurality of straps 105 including a corresponding plurality of collar receivers 102A and first members 105A.

It shall be noted that the strap(s) 105 is generally parallel with the collar 102 and is attached to and positioned above the collar 102. Moreover, the strap(s) 105 is responsible for securing the flashlight 130 to the invention 100.

The straps 105 each include a strap receiver 105D with a second pin 105E that is used to adjust a circumference of the strap 105 formed with a plurality of equally spaced strap holes 105F provided along the length of the respective strap 105. The strap receiver 105D and second pin 105E enable the adjustment of the circumference of the strap(s) 105 in order to tighten and secure the invention 100 onto the flashlight 130. Moreover, the strap(s) 105 adjust the circumference to accommodate differently sized flashlights 130.

Moreover, the number of strap receivers 105D shall correspond to the number of collar receivers 102A. It shall be noted that the straps 105 and the first members 105A shall be made of a rigid, yet flexible material, and may comprise a plastic or rubber.

Figure 4:
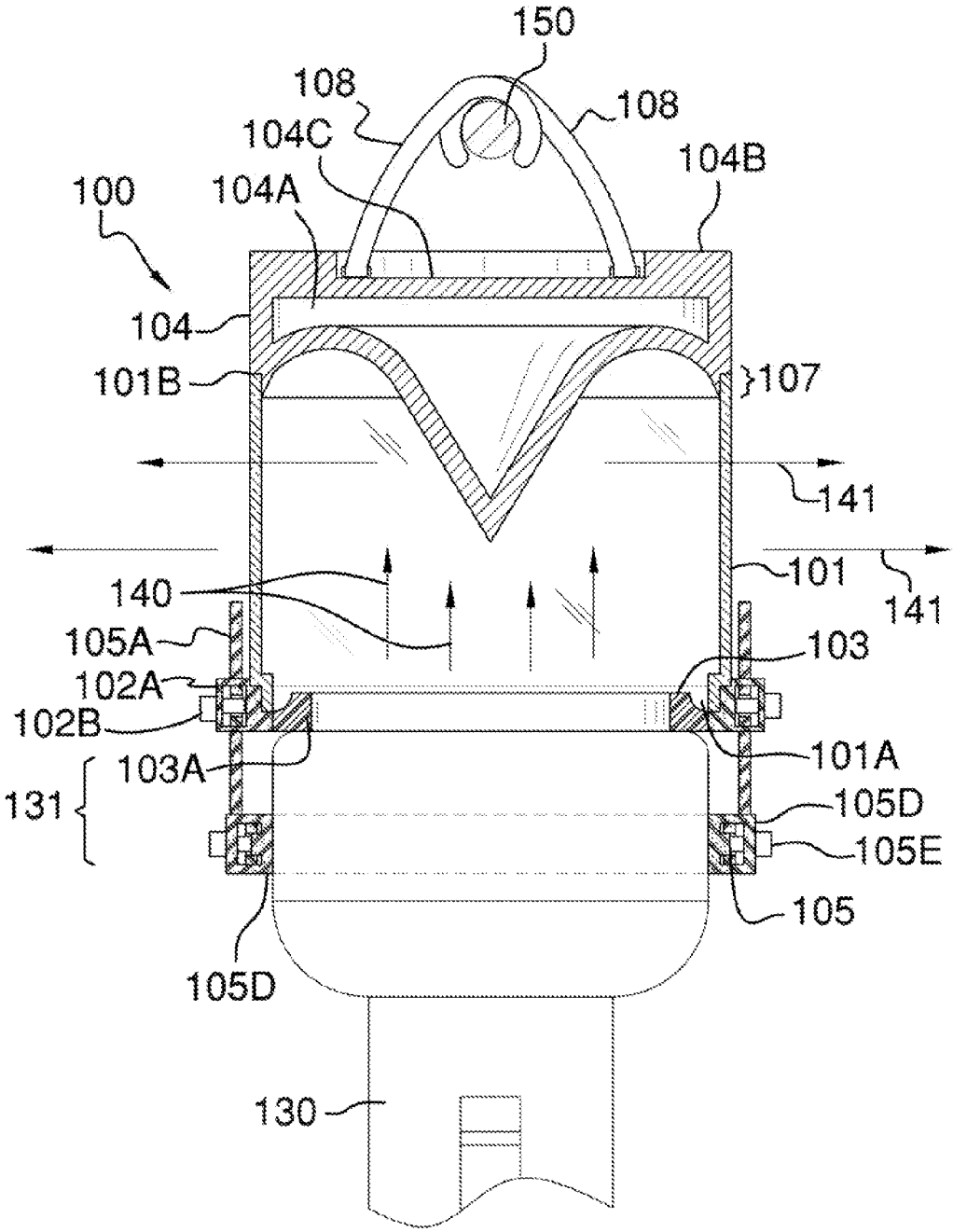
FIG. 4 illustrates a cross-sectional view of the flashlight accessory along line 4-4 in FIG. 1, and detailing the inclusion of the lighted end of the existing flashlight into the opening of the flashlight accessory as well as hooks extending upwardly from the external distal end and hooked onto an object.
Figure 5:
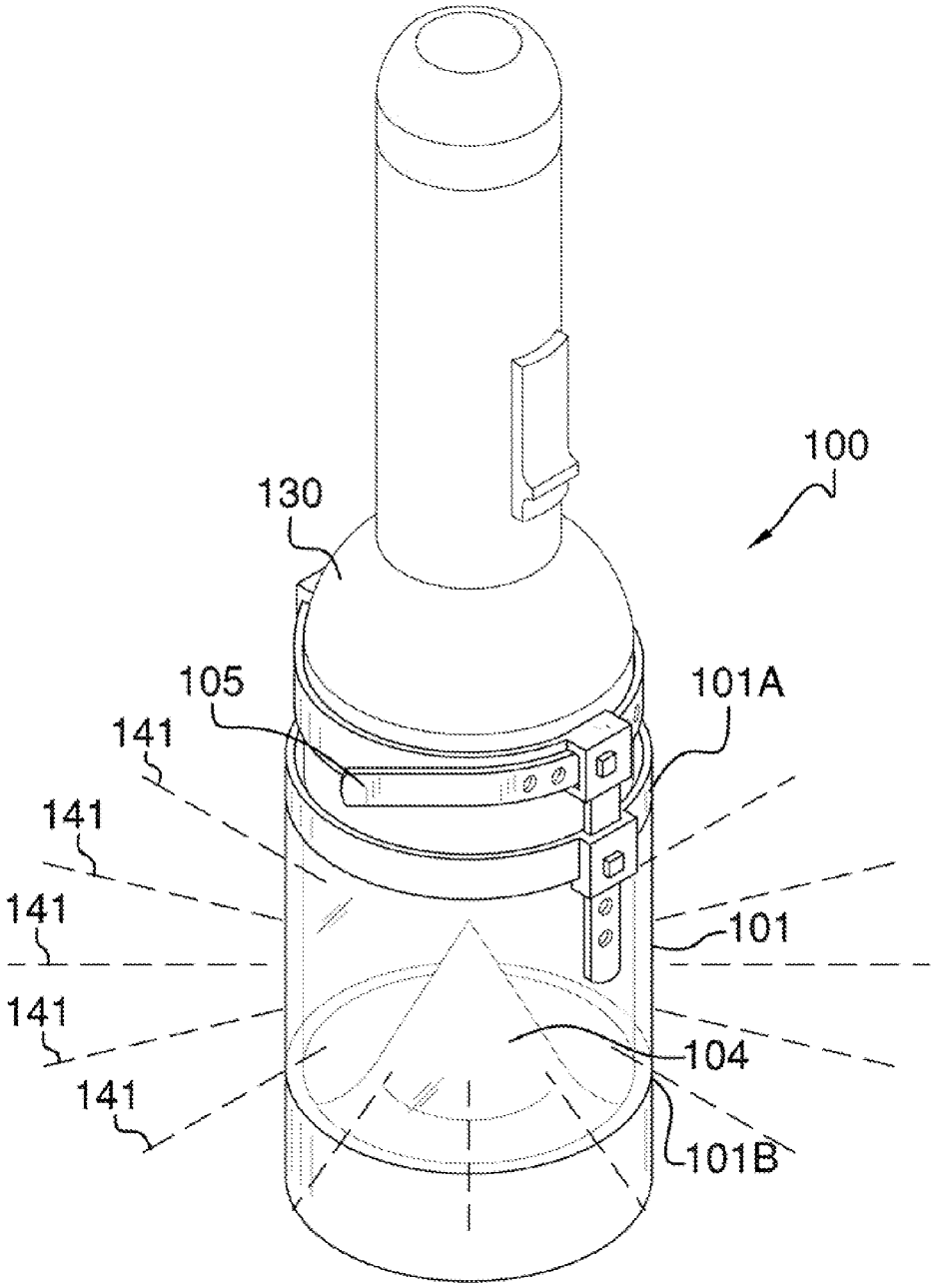
FIG. 5 illustrates a perspective view of the flashlight accessory in use with an existing flashlight wherein light is reflected radially via the reflective cone shaped surface and with the accessory lying upon a flat surface.

It shall be noted that where the adjustable collar 102 and the hollowed cylinder 101 attach is a notch 106 formed in both components, which is depicted in FIG. 4. It shall be further noted that the reflective cone shaped surface 104 attaches to the bottom opening 101B of the hollowed cylinder 101 via a groove 107, which is integrated into the design of the reflective cone shaped surface 104.

It may be further noted that the reflective cone shaped surface 104 may include a hollow back 104A as well as a flat bottom edge 104B, which shall enable both the invention 100 and the flashlight 130 to stand in a vertical arrangement upon a flat surface 150.

Figure 6:
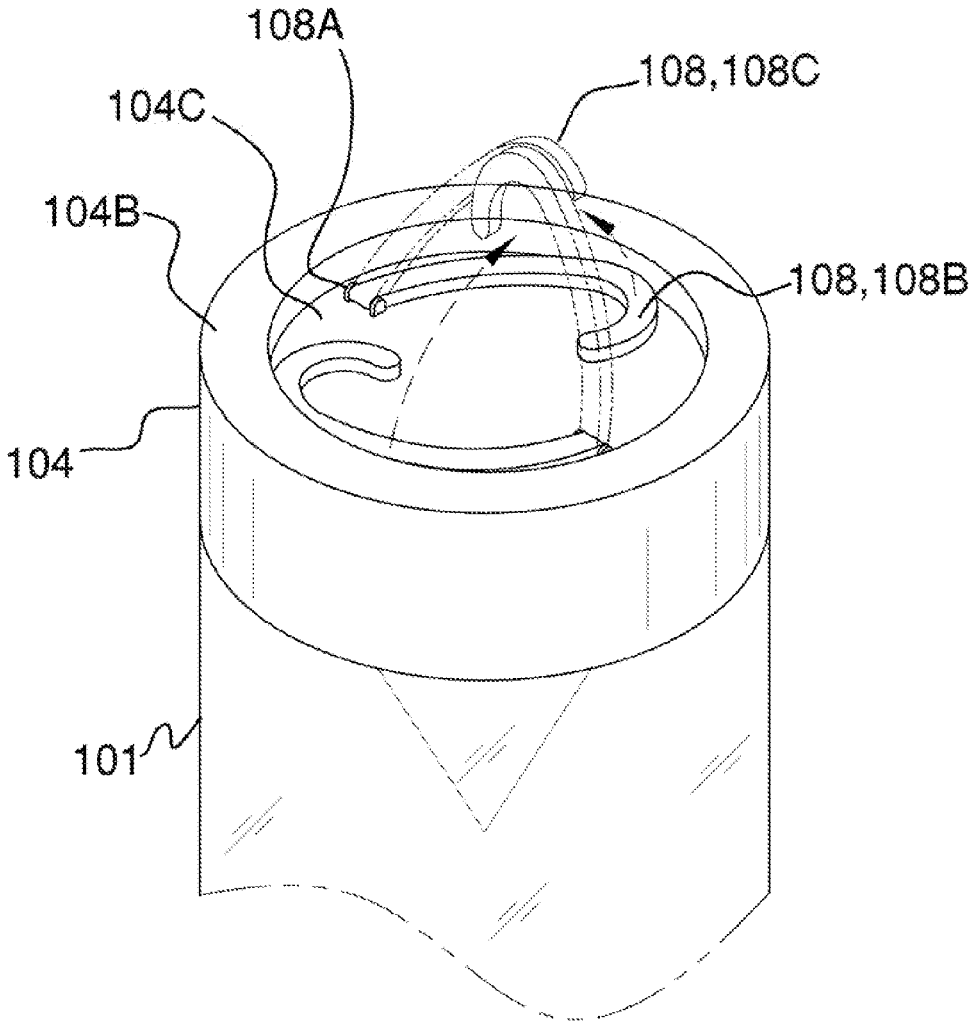
FIG. 6 illustrates a detail of the hooks extending from a prone position atop of the external distal end of the hollowed cylinder.

Referring to FIGS. 4 and 6, the bottom edge 104B may also be referred to as an external distal end. The bottom edge 104B may incorporate at least one hook 108 that rotates about a pivot point 108A to move between a prone position 108B to an extended position 108C wherein the hook 108 can support the invention 100 upon an object 150. Moreover, the bottom edge 104B shall include a recess 104C to accommodate the hooks 108 such that the invention 100 may rest upon a ground surface as in FIG. 5.

It shall be noted that the hook 108 may work in concert in pairs to provide ample support to the invention 100 in light of the overall weight of the flashlight 130 in conjunction with the weight of the invention 100.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A flashlight accessory comprising:

a hollowed cylinder from which a collar extends along a top opening in order to align and rest against a lighted end of an existing flashlight;

wherein a reflective cone shaped surface attaches onto a bottom opening of the hollowed cylinder such that light emitted from said flashlight shall reflect radially with respect to said flashlight;

wherein a strap is attached to and positioned above said collar;

wherein said strap encircles a portion of the flashlight in order to secure said flashlight to the flashlight accessory.

2. The flashlight accessory as described in claim 1 wherein the hollowed cylinder is of a length, and is made of a translucent material such that reflected light from the reflective cone shaped surface shall pass through the hollowed cylinder radially.

3. The flashlight accessory as described in claim 1 wherein the collar is affixed to the top, opening of the hollowed cylinder, and extends vertically therefrom.

4. The flashlight accessory as described in claim 3 wherein the collar and the hollowed cylinder each include a notch where both the collar and the hollowed cylinder attach to one another.

5. The flashlight accessory as described in claim 1 wherein a support lip is provided along the intersection of the collar and the top, opening of the hollowed cylinder; wherein the support lip is a ring-shaped object forming a hole through which light from the flashlight shall pass before entering the hollowed cylinder; wherein the support lip acts as a stop, and prevents the flashlight from protruding through the top, opening of the hollowed cylinder.

6. The flashlight accessory as described in claim 1 wherein the reflective cone shaped surface attaches to the bottom opening of the hollowed cylinder via a groove, which is integrated into the design of the reflective cone shaped surface.

7. The flashlight accessory as described in claim 1 wherein the reflective cone shaped surface includes a hollow back as well as a flat bottom edge, which enables both the flashlight accessory and the flashlight to stand in a vertical arrangement upon a flat surface.

8. The flashlight accessory as described in claim 7 wherein the flat, bottom edge includes a recess within which at least one hook attaches via a pivot point; wherein said hook shall rotate from either a prone position to an extended position in order to enable the flashlight accessory to hang from an object.

9. The flashlight accessory as described in claim 1 wherein the collar includes a collar opening into which the lighted end of the flashlight is inserted; wherein the collar includes at least one collar receiver that works in conjunction with the strap to adjust an elevation of said strap above the collar.

10. The flashlight accessory as described in claim 9 wherein the strap includes a first member that is slideably engaged with respect to the collar receiver; wherein the first member includes a plurality of equally spaced first holes, which are engaged with a first pin of said collar receiver to adjust and lock the strap at varying elevations with respect to the collar.

11. The flashlight accessory as described in claim 10 wherein the strap includes a strap receiver with a second pin that is used to adjust a circumference of the strap formed with a plurality of equally spaced strap holes provided along the length of the respective strap.

12. A flashlight accessory comprising:

a hollowed cylinder from which a collar extends along a top opening in order to align and rest against a lighted end of an existing flashlight;

wherein a reflective cone shaped surface attaches onto a bottom opening of the hollowed cylinder such that light emitted from said flashlight shall reflect radially with respect to said flashlight;

wherein the collar includes a collar opening into which the lighted end of the flashlight is inserted; wherein the collar includes at least one collar receiver that works in conjunction with a strap to adjust an elevation of said strap above the collar;

wherein the strap being generally parallel with the collar is attached to and positioned above said collar;

wherein said strap encircles a portion of the flashlight in order to secure said flashlight to the flashlight accessory.

13. The flashlight accessory as described in claim 12 wherein the hollowed cylinder is of a length, and is made of a translucent material such that reflected light from the reflective cone shaped surface shall pass through the hollowed cylinder radially.

14. The flashlight accessory as described in claim 12 wherein the collar is affixed to the top, opening of the hollowed cylinder, and extends vertically therefrom; wherein the collar and the hollowed cylinder each include a notch where both the collar and the hollowed cylinder attach to one another.

15. The flashlight accessory as described in claim 12 wherein a support lip is provided along the intersection of the collar and the top, opening of the hollowed cylinder; wherein the support lip is a ring-shaped object forming a hole through which light from the flashlight shall pass before entering the hollowed cylinder; wherein the support lip acts as a stop, and prevents the flashlight from protruding through the top, opening of the hollowed cylinder.

16. The flashlight accessory as described in claim 12 wherein the reflective cone shaped surface attaches to the bottom opening of the hollowed cylinder via a groove, which is integrated into the design of the reflective cone shaped surface.

17. The flashlight accessory as described in claim 12 wherein the reflective cone shaped surface includes a hollow back as well as a flat bottom edge, which enables both the flashlight accessory and the flashlight to stand in a vertical arrangement upon a flat surface.

18. The flashlight accessory as described in claim 17 wherein the flat, bottom edge includes a recess within which at least one hook attaches via a pivot point; wherein said hook shall rotate from either a prone position to an extended position in order to enable the flashlight accessory to hang from an object.

19. The flashlight accessory as described in claim 12 wherein the strap includes a first member that is slideably engaged with respect to the collar receiver; wherein the first member includes a plurality of equally spaced first holes, which are engaged with a first pin of said collar receiver to adjust and lock the strap at varying elevations with respect to the collar.

20. The flashlight accessory as described in claim 19 wherein the strap includes a strap receiver with a second pin that is used to adjust a circumference of the strap formed with a plurality of equally spaced strap holes provided along the length of the respective strap.

* * * * *